United States Patent [19]

Ramus

[11] Patent Number: 4,815,198

[45] Date of Patent: Mar. 28, 1989

[54] METHOD FOR MAKING A PART OF AN ELECTRICALLY HEATED WINDSHIELD ASSEMBLY

[75] Inventor: Kevin J. Ramus, Dearborn, Mich.

[73] Assignee: Ford Motor Company, Dearborn, Mich.

[21] Appl. No.: 728,631

[22] Filed: Apr. 29, 1985

[51] Int. Cl.[4] ..... H05B 3/00

[52] U.S. Cl. ..... 29/611; 118/505; 427/163

[58] Field of Search ..... 29/611; 427/163; 118/505; 219/203, 522, 543

[56] References Cited

U.S. PATENT DOCUMENTS

| | | | |
|---|---|---|---|
| 2,954,454 | 9/1960 | Gaiser | 219/522 |
| 3,078,693 | 2/1963 | Lytle | 427/163 |
| 3,523,858 | 10/1970 | Peete | 219/543 |
| 3,892,947 | 7/1975 | Strengholt | 219/203 |
| 3,893,234 | 7/1975 | Levin | 427/163 |
| 4,017,661 | 4/1977 | Gillery | 219/522 |
| 4,195,590 | 4/1980 | Herrington | 118/505 |
| 4,385,226 | 5/1983 | Sauer | 219/543 |
| 4,543,466 | 9/1985 | Ramus | 219/203 |

*Primary Examiner*—P. W. Echols

*Attorney, Agent, or Firm*—William E. Johnson; Clifford L. Sadler

[57] ABSTRACT

This specification is directed to a process for making part of an electrically heated windshield assembly. The process includes the steps of selecting a glass sheet 10. The glass sheet is formed into a windshield configuration. At least a pair of electrically conductive bus bars (14, 16) are formed on the glass sheet. One bus bar (14) extends along a lower edge of the glass sheet. A second of the bus bars (16) extends along at least a short portion (20) of the lower edge of the glass sheet in a location spaced away from the bus bar (14) and near the lower edge of the glass sheet, up a side edge of the lower edge of the glass sheet as an edge portion (22), and along an upper edge of the glass sheet as an upper portion (24). A snap-on protective member (30) is placed on the glass sheet which engages both front and back surfaces of that glass sheet. The snap-on protective member covers over lower portions and side edge portions of the second bus bar (16). The surface of the glass sheet having the bus bars thereon is subjected to a vacuum metal deposition process to form an electrically conductive coating (32) between the bus bars uncovered by the snap-on protective member. Thereafter, the snap-on protective member is removed to complete a part of the electrically heated windshield assembly.

3 Claims, 1 Drawing Sheet

METHOD FOR MAKING A PART OF AN ELECTRICALLY HEATED WINDSHIELD ASSEMBLY

TECHNICAL FIELD

This application is directed to a method for making a part of an electrically heated windshield assembly. The part of the electrically heated windshield assembly made is that part which includes forming electrically conductive bus bars on a glass sheet and joining the bus bars together with a conductive coating which is deposited by a vacuum metal deposition process. The part of the electrically heated windshield assembly so made may be subsequently laminated to another glass sheet and the electrical portions thereof connected to suitable electrical circuitry to form an electrically heated windshield. Such a windshield may be used as a vision unit in an automobile and it may be defogged or deiced by application of an electric current between the bus bars in order that the electrically conductive coating extending between the bus bars generates heat.

BACKGROUND AND PRIOR ART STATEMENT

Electrically heated windshields are being introduced in the U.S. automotive market. These windshields find particular utility as the forward vision unit for automobiles. Since such windshields are heated by the electrical system of the motor vehicle, the defogging and deicing of the windshield may be accomplished as soon as the key is turned on in the vehicle to actuate the electrical system thereof. There is no waiting for the engine to heat a fluid so that heat may be derived from the fluid in the normal heating and defrosting mode of the heater. The heating is accomplished by flowing electrical energy from one bus bar to another bus bar through a conductive coating that is formed as part of the windshield. The conductive coating, of course, has to be substantially transparent so that the unit may serve as a vision unit.

The particular improvement of my invention is the manner in which a part of the electrically heated windshield assembly is formed as will become more apparent from the description set forth hereinbelow.

A search was carried out on the subject matter of this disclosure in the U.S. Patent and Trademark Office. As a result of that search, the following U.S. patents were cited: U.S. Pat. Nos. 2,761,945; 3,063,881; 3,532,858; and 4,385,226. I will discuss each of these patents briefly below.

U.S. Pat. No. 2,761,945, issued on Sept. 4, 1956, for a "Light Transmissive Electrically Conducting Article." This patent discloses an electrically conductive, light transmissive article. The article includes a transparent support body and a light transparent metal film permanently adhered to one entire surface of the support body. A relatively hard transparent protective coating covers the metal film and terminates inwardly of opposed marginal areas of that film. A highly electrically conductive material is applied as an electrode over the exposed marginal edge areas of the metal film in direct contact therewith. The electrically conductive material overlaps a portion of the protective coating.

U.S. Pat. No. 3,063,881, issued on Nov. 13, 1962, for a "Method of Making an Electrically Conductive Article." This patent discloses a method of uniformly increasing the overall resistance of a transparent electrically conductive article without altering the optical characteristics thereof. The method disclosed is one wherein a transparent electrically conductive film having a protective coating thereon covers over an entire surface of a transparent support body. A pair of spaced electrodes are provided which cover the film along oppositely disposed edges of the support body so as to supply electrical current to the film. The method of this patent is one which comprises masking at least one of the electrodes along a substantially straight line extending the entire length of the electrode and thereafter removing that portion of the electrode which lies between the line and the inner edge of the electrode. In this manner the distance through which the current passes is increased as it flows between the electrodes. Thereafter, a protective coating is placed over the surface of the exposed film.

U.S. Pat. No. 3,532,858, issued on Oct. 6, 1970, for a "Thermal Window." This patent discloses a thermal window which is of the following construction. A mounting gasket is provided of resilient, rubbery dielectric material having a channel therein extending along its longitudinal dimension. This channel defines spaced side walls. A pane of glass, having an edge fitting the channel, is also provided. A thermal grid, including a plurality of electrical conductor strips, extends in spaced relation permitting visibility through the pane. These thermal strips generally extend in spaced relationship in a direction generally transverse of the channel. A bus bar electrically connects the ends of the strips and is interposed between the pane and one side wall of the channel. The bus bar has an edge portion exposed to the atmosphere extending longitudinally along the gasket out of contact therewith. The edge portion is adequate in itself to carry the electrical current passing through the thermal grid.

U.S. Pat. No. 4,385,226, issued on May 24, 1983 , for an "Electrically Heated Window." This patent discloses an electrically heated windshield which achieves a more uniform current density at the interface between the resistive heating layer and the current-bearing electrodes to which it is connected. In one embodiment, the more uniform current density connection is achieved by forming the edge of the electrode in an undulating shape. The connection may also be made by increasing the surface resistance of the electrode near its edge by, for example, forming the edge so that it is wedge-shaped in cross-section. More uniform current density may also be achieved by using an electrode which has a resistivity that is greater than that of the resistive heating layer. It may also be achieved by use of a high resistivity layer located between the electrode and the resistive heating layer.

It is my opinion that none of the prior art cited in the search report carried out on the subject matter of this specification anticipates my method for making part of an electrically heated windshield assembly. These patents are devoid of teaching or any suggestion of the method of my invention as will become readily apparent upon further reading of this specification.

DISCLOSURE OF INVENTION

In a method of making an electrically heated windshield assembly, I have invented a method for making part of that assembly, which comprises the following steps.

A glass sheet is selected. The glass sheet is formed into a windshield configuration.

At least a pair of electrically conductive bus bars are formed on the glass sheet. One of the bus bars extends along the lower edge of the glass sheet. A second of the bus bars extends (1) along at least a short portion of the lower edge of the glass sheet in a location spaced away from the one bus bar and nearer the lower edge of the glass sheet than the one bus bar, (2) up a side edge of the glass sheet, and (3) along an upper edge of the glass sheet.

A snap-on protective member is placed on the glass sheet which engages both the front and the back surfaces of the glass sheet. The snap-on protective member covers over all of the short portion of the second bus bar as well as that portion of the second bus bar extending up the side edge of the glass sheet. Because the shape of the protective member and the edge of the glass sheet are very similar, the protective member is easily located in its proper position. The protective member is just about self-centering.

The surface of the glass sheet having the bus bars thereon is subjected to a vacuum metal deposition process to form an electrically conductive coating between the bus bars left uncovered by the snap-on protective member. The snap-on protective member is removed after the coating operation is completed to complete a part of an electrically heated windshield assembly.

The part of the electrically heated windshield assembly made by the method of my invention may then be laminated to another glass sheet in a laminating operation well known in the art in order to form a laminated windshield. Such a windshield may then be installed in a motor vehicle. The bus bars are connected to suitable electric circuitry, and when electrical energy flows through the bus bars, the conductive coating is heated in order to defog and deice the windshield.

BRIEF DESCRIPTION OF THE DRAWINGS

The novel features that are considered characteristic of the method of my invention are set forth with particularity in the appended claims. The invention itself, however, both as to its organization and its method of operation, together with additional objects and advantages thereof, will best be understood from the following description of specific embodiments when read in connection with the accompanying drawings, wherein like reference characters indicate like parts throughout the several figures, and in which:

BEST MODE AND INDUSTRIAL APPLICABILITY

The following description is what I consider to be a preferred embodiment of my method for making a part of an electrically heated windshield assembly. The following description also sets forth what I now contemplate to be the best mode of carrying out my inventive method. My description is not intended to be a limitation upon the broader principles of this method, and while preferred materials are used to form the assembly in accordance with the requirement of the laws, it does not mean that other materials cannot be used in my method.

In a method of making an electrically heated windshield assembly, I teach a method for making part of that assembly. The method of my invention includes the following steps.

Figure 1:
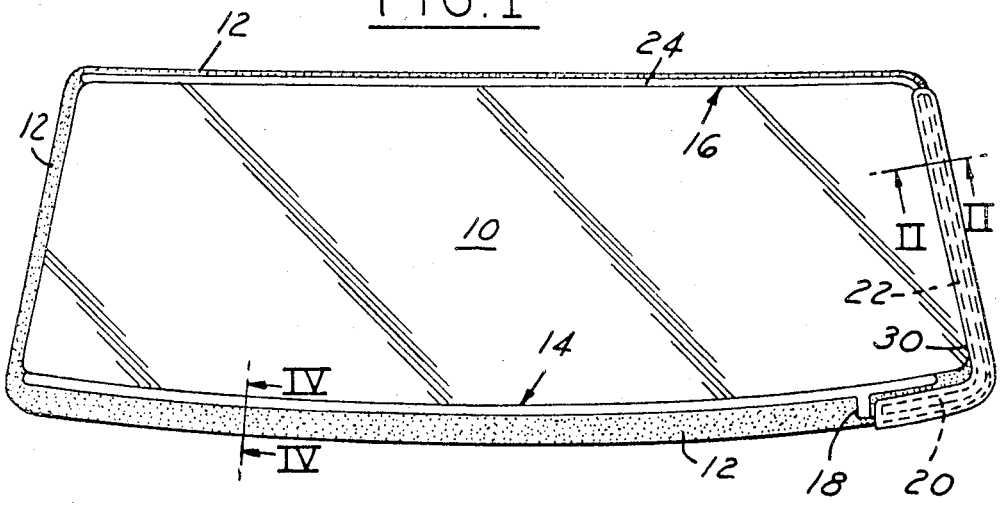
FIG. 1 is an elevation view of the part of an electrically heated windshield assembly made by the method of my invention.

A glass sheet 10 is selected. The glass sheet is formed into a windshield configuration as is shown in FIG. 1. As is known to the skilled artisan, normally two individual sheets of glass are cut to form a laminated windshield assembly. The two sheets of glass are bent together on a single bending fixture in a glass bending operation if the windshield is to have any curvature therein. The two sheets are then separated while the one sheet of glass 10 is further processed. At a later portion the two sheets of glass are once again united with an interposed laminating interlayer material and a laminating operation carried out thereon to bond the two sheets of glass together as a laminated windshield assembly. The methods of cutting, bending and laminating two sheets of glass to form a laminated windshield are well known in the art and no further discussion thereof will be undertaken herein.

The methods of my invention may also be applicable to cases in which a single piece of glass is being used to form the windshield. In such case the coating will normally be on the inside surface of the piece of glass and some other additional protective coating (generally plastic in character) is placed thereover. Thus, the method of my invention is directed to making electrically heated windshield assemblies in which there is either a laminated two-ply assembly or a single glass sheet with a protective plastic coating thereon.

As an additional matter, in the preferred embodiment disclosed herein, a black-out edge band 12 is placed around the entire perimeter of the glass. The surface on which this black-out is placed is the surface of the windshield facing the laminating material. It would be the outwardly facing surface of the inner glass sheet in a laminated windshield. This black-out edge band is formed by applying ceramic frit-containing materials, as well known in the art, and heating the glass sheet 10 to a proper temperature in order to bond the same thereon.

Once the black-out edge band 12 has been applied, a pair of electrically conductive bus bars, generally identified by the numerals 14 and 16, respectively, are applied to the glass sheet. The bus bar 14 extends along a lower edge of the glass sheet. This bus bar has a terminal area 18 associated therewith. The bus bar 14 generally extends across the entire length of the lower edge of the glass sheet at a position located on the black-out edge band material so that the bus bar is not visible through the glass from the inside of the vehicle.

The second bus bar 16 has a terminal area 20 extending along a short portion of the lower edge of the glass sheet 10 in a location spaced away from the bus bar 14 and near the terminal area 18 of the bus bar 14. Electrical connection may be made by suitable electrical connectors to the terminal areas 18 and 20 in order to provide an electrical contact to the bus bars and thence to the conductive coating, which will be described hereinbelow. The bus bar 16 also has a portion thereof 22 extending up a side edge of the glass sheet 10. An upper portion 24 of the bus bar 16 extends along an upper edge of the glass sheet. In the preferred embodiment, the terminal area 20, side portion 22, and upper portion 24 of the bus bar 16 are also placed over the black-out edge band 12 so that they are hidden from view.

The bus bars 14 and 16 are formed from a silver ceramic-containing material and are placed on the black-out edge band in a silk screen printing operation. Once the printing operation has been completed, the bus bars are subjected to a firing operation as known to skilled artisans in which they are heated in order to drive off the volatile materials and develop a conductive bus bar which is firmly bonded to the black-out edge band therebelow.

Figure 2:
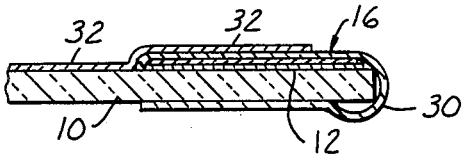
FIG. 2 is a cross-sectional view taken along line II—II of FIG. 1.
Figure 6:
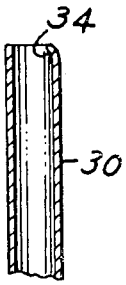
FIG. 6 is a cross-sectional view taken along line VI—VI of FIG. 5 showing greater detail of the snap-on protective member.
Figure 5:
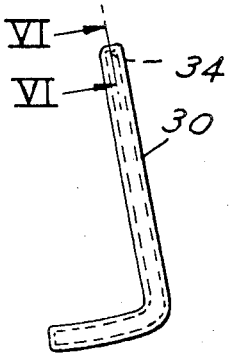
FIG. 5 is a view of the snap-on protective member.

In accordance with the teachings of the method of my invention, as best seen in FIGS. 1, 5 and 6, a snap-on protective member 30 is provided. This snap-on protective member may be made from a suitable resilient plastic or metal material. As best seen in FIG. 2, when in proper position, the snap-on protective member has elements which engage both the front and the back surfaces of the glass sheet. The snap-on protective member is placed on the glass sheet 10 after the bus bars 14 and 16 have been firmly bonded to the black-out edge band which also has been firmly bonded to the glass sheet. When properly located, the snap-on protective member 30 covers over all of the terminal area 20 of the bus bar 16 as well as substantially most or all of the side portion 22 of the bus bar 16. The upper portion 24 of the bus bar 16 is left exposed as is the entire portion of the bus bar 14. The protective member has the same general shape as the side edges of the glass sheet it covers. The protective member is easily located in its proper position on the glass sheet. The protective member is just about self-centering when applied to the glass sheet.

Figure 4:
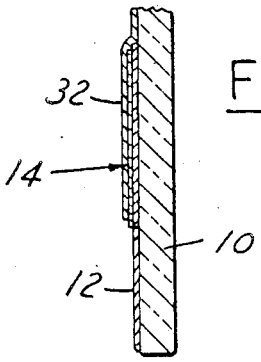
FIG. 4 is a cross-section view taken along line IV—IV of FIG. 1.

After the snap-on protective member 30 has been placed on the glass sheet 10, as described above, it is subjected to a high vacuum metal deposition process to form an electrically conductive coating between the bus bar 14 and the uncovered portion of the bus bar 16. A vacuum metal deposition process which is suitable for applying such a coating is a magnetron sputtering operation, well known to those skilled in the art. Such an operation may be carried out to provide on the glass sheet a conductive coating 32 formed of silver and metal oxides and having about 0.1 micrometers thickness. As best seen in FIG. 4, where no snap-on protective member is used, the conductive coating comes up from the glass sheet and rides up onto the bus bar 14. For a short period of time the conductive coating also rides over the black-out coating 12 before it reaches the bus bar 14. In a similar manner, the portion of the coating which covers the unexposed portion of the bus bar 16 also rides up and covers this bus bar to make direct electrical contact therewith.

Figure 3:
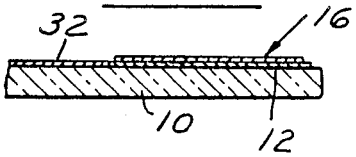
FIG. 3 is a view similar to FIG. 2, except that a snap-on protective member is removed.

However, as best understood by reference to FIGS. 2 and 3, the area protected by the snap-on protective member 30 is one in which the conductive coating 32 will ride along the glass and then up onto the snap-on protective member. When the snap-on protective member is removed, it carries with it that portion of the coating 32 which would have otherwise overlaid the bus bar protected thereby. Thus, in the area protected by the snap-on protective member, the conductive coating (as best seen in FIG. 3) does not ride up to and over the protected bus bar area. The conductive coating is terminated before the beginning of the bus bar, the difference in distance between the two being determined by the dimensions of the snap-on protective member.

The snap-on protective member 30 is best understood by looking at FIGS. 5 and 6 of the drawing.

As best seen in FIG. 5, the snap-on protective member is designed so that it covers the area desired to be covered on the second bus bar 16 when the member is applied to the glass sheet 10. This member may be formed of resilient metal or plastic, or combination thereof, so long as it has a springy characteristic and can be reused. The material also should be one from which the conductive coating 32 that overlies the upper portion thereof can be easily removed in a cleaning operation. I prefer to make the snap-on protective member from stainless steel with a Teflon coating thereon. As noted in FIG. 6, the member has, in its preferred embodiment, a spring edge portion 34 which insures a good gripping of the glass at the top edge thereof and a clear delineation between the point at which the upper bus bar portion 24 is coated over by the conductive coating 32 and that portion of the bus bar which is not coated. By such action there is a clear delineation between the upper portion 24 of the bus bar 16, which is electrically connected to the conductive coating 32, and the bus bar 14, which is connected throughout its entire extent to the conductive coating 32. Thus, the two bus bars are connected to the conductive coating respectively at the bottom and the top of the glass sheet 10, whereby current may flow between the bus bars to produce heat in the conductive coating.

Since the preferred embodiment of this invention is a laminated glass windshield, further processing steps known to those skilled in the art will be required to complete an electrically heated windshield. For example, the snap-on protective member 30 is removed after the coating operation putting down the conductive coating 32 has been completed. Once that operation has been carried out, a laminating interlayer and the previously formed other glass sheet which forms the outer glass sheet of the laminated assembly is brought into contact with the glass sheet 10 and the interposed layer of vinyl and processed in accordance with well-known processing parameters to achieve a laminated windshield. When the laminated windshield is installed in a motor vehicle, the terminal area 18 of bus bar 14 and the terminal area 20 of bus bar 16 are connected through suitable structure to the electrical system of the vehicle. When current is applied to the conductive coating 32, the conductive coating heats up and in turn causes a very rapid defogging and deicing of the windshield surface area.

While a preferred embodiment of the method of my invention has been illustrated and described, it will be obvious to those skilled in the art that various changes and modifications may be made without departing from the invention, and it is intended to cover in the appended claims all such modifications and equivalents as fall within the true spirit and scope of this invention.

I claim:

1. In a method of making an electrically heated windshield assembly, a method for making part of that assembly which comprises the steps of:

selecting a glass sheet;

forming said glass sheet into a windshield configuration;

forming at least a pair of electrically conductive bus bars on said glass sheet, one of said bus bars extending along a lower edge of said glass sheet and a second of said bus bars extending (1) along at least a short portion of said lower edge of said glass sheet in a location spaced away from said one bus bar and nearer said lower edge of said glass sheet than said one bus bar, (2) up a side edge of said glass sheet, and (3) along an upper edge of said glass sheet;

placing a snap-on protective member on said glass sheet which engages both front and back surfaces of said glass sheet, said snap-on protective member covering over all of said short portion of said second bus bar as well as said portion of said second bus bar extending up said side edge of said glass sheet;

subjecting said surface of said glass sheet having said bus bars thereon to a vacuum metal deposition process to form an electrically conductive coating between said bus bars left uncovered by said snap-on protective member; and removing said snap-on protective member after said coating operation is completed to complete a part of an electrically heated windshield assembly.

2. The method of claim 1, wherein said glass sheet selected is one of a pair of glass sheets which can be laminated to form a laminated glass windshield.

3. The method of claim 1, wherein said glass sheet selected is a single glass sheet which subsequently has a coated surface covered with plastic to form a windshield.

* * * * *